US005426867A

United States Patent [19]

Yli-Kauppila et al.

[11] Patent Number: 5,426,867

[45] Date of Patent: Jun. 27, 1995

[54] DRYER SECTION OF A PAPER MACHINE

[75] Inventors: Jouko Yli-Kauppila, Muurame; Mikko Siiteri, Espoo, both of Finland

[73] Assignee: Valmet Paper Machinery, Inc., Helsinki, Finland

[21] Appl. No.: 174,719

[22] Filed: Dec. 29, 1993

[30] Foreign Application Priority Data

Aug. 23, 1993 [FI] Finland ..... 933700

[51] Int. Cl.[6] ..... F26B 3/00

[52] U.S. Cl. ..... 34/452; 34/117; 34/120

[58] Field of Search ..... 34/114–120, 34/452–458; 162/206, 207

[56] References Cited

U.S. PATENT DOCUMENTS

| | | | |
|---|---|---|---|
| 2,537,129 | 1/1951 | Goodwillie | 162/290 |
| 3,250,019 | 5/1966 | Beachler | 34/117 |
| 3,816,941 | 6/1974 | Holik et al. | 34/117 |
| 4,183,148 | 1/1980 | Koski et al. | 34/116 |
| 4,202,113 | 5/1980 | Kankaanpaa | 34/23 |
| 4,481,723 | 11/1984 | Vedenpää | 34/116 |
| 4,649,964 | 3/1987 | Smith | 34/116 |
| 4,821,429 | 4/1989 | Sieberth | 34/116 |
| 4,882,855 | 11/1989 | Loser et al. | 34/116 |
| 4,918,836 | 4/1990 | Wedel | 34/117 |
| 5,172,491 | 12/1992 | Ilvespaa et al. | 34/115 |
| 5,279,050 | 1/1994 | Törmänen | 34/117 |

FOREIGN PATENT DOCUMENTS

| | | |
|---|---|---|
| 8806204 | 8/1988 | WIPO . |
| 8806205 | 8/1988 | WIPO . |

*Primary Examiner*—Denise L. Gromada
*Attorney, Agent, or Firm*—Steinberg, Raskin & Davidson

[57] ABSTRACT

Dryer section of a paper machine having so-called normal drying groups with a single-wire draw, heated contact drying cylinders arranged in an upper row and leading cylinders or rolls arranged in a lower row. At least one drying module is arranged between and/or inside the normal drying groups and in which the opposite side of the web, in relation to the side of the web placed against the contact-drying cylinders, is placed against the heated cylinder face of a single large drying cylinder or cylinders in the drying module. The web is placed in direct contact against the heated cylinder face of the large drying cylinders. The drying module includes a separate loop of a drying wire which guides the web and presses its opposite side against the heated face of the large cylinders over a sector which is greater than about 180°. The diameter of the large drying cylinder(s) is larger than the diameter of the contact drying cylinders in the normal drying groups.

35 Claims, 9 Drawing Sheets

DRYER SECTION OF A PAPER MACHINE

BACKGROUND OF THE INVENTION

The present invention relates to a dryer section of a paper machine in which so-called normal drying groups having a single-wire draw are provided with heated contact-drying cylinders arranged in an upper row and leading cylinders or rolls arranged in a lower row. At least one drying module in accordance with the present invention is arranged between adjacent normal drying groups and/or inside the normal drying groups in the dryer section between a pair of drying cylinders. In the drying module, the side of the web which is not placed against the contact-drying cylinders in the normal drying groups, i.e., an opposite side of the web, is placed against the heated cylinder face of a large drying cylinder. The present invention also relates to a method for drying a paper web.

The highest web speeds in paper machines are currently already in a range of about 25 meters per second. In the near future, the web speeds which will be used in paper machines will be in a range from about 25 m/s to about 40 m/s. With the current highest running speeds of webs and with even higher future running speeds planned, the dryer section in particular has become, and will be, the bottleneck of the runnability of a paper machine, i.e., it will impede the functionality of the advantageously higher web running speeds. Thus, it is desirable to develop new methods and devices to increase the speed of the web through the drying section.

Another aspect of paper machine technology is that the quality requirements imposed on the paper produced, in particular on fine paper and copying paper, are even now quite strict, and will become even more demanding. Particularly high requirements are imposed on the symmetry of the paper in the z-direction and on the properties of both sides of the face of the paper web as well as on the stability of the paper structure as the paper is heated rapidly in a copying or printing process. These quality requirements of a paper product impose particularly high requirements on the dryer section of a paper machine. However, these requirements are ever more difficult to meet with increasing web running speeds.

In the prior art, a twin-wire draw and a single-wire draw are used in multi-cylinder dryers of paper machines. In a twin-wire draw, the groups of drying cylinders have two wires which press the web, one from above and the other one from below, against the heated cylinder faces of the drying cylinders. Between the rows of drying cylinders, which are usually horizontal rows, the web has free and unsupported draws. These free draws are susceptible to fluttering, possibly causing undesirable web breaks. For this reason, in recent years, increasing use has been made of the single-wire draw, in which there is only one drying wire in each group of drying cylinders. In the single-wire draw type of drying group, the web runs through the whole group on support of the drying wire so that the drying wire presses the web against the heated cylinder faces of the drying cylinders. The web remains at the side of the outside curve on the leading cylinders between the drying cylinders. Thus, in a single-wire draw, the drying cylinders are arranged outside the wire loop and the leading cylinders are arranged inside the drying wire loop.

In the prior art, in normal groups with a single-wire draw, the heated drying cylinders are usually placed in the upper row and correspondingly, the leading cylinders are placed in the lower row. Typically, the rows are horizontal and parallel to one another. Finnish Patent No. 54,627 (corresponding to U.S. Pat. No. 4,202,113, the specification of which is incorporated by reference herein) describes an arrangement wherein normal single-wire groups and so-called inverted single-wire groups are arranged one after the other. In the inverted groups, the heated drying cylinders are placed in the lower row and the leading suction cylinders or rolls are placed in the upper row so that the principal objective, i.e., drying the web symmetrically from both of its sides, is accomplished.

Other references (of Beloit Corp.) also describe a dryer section that includes normal and inverted cylinder groups. In this regard, reference is made to published International Patent Applications WO 88/06204 and WO 88/06205.

With further respect to the prior art, reference is made to U.S. Pat. No. 2,537,129 wherein FIG. 4 illustrates an inverted cylinder group followed by a drying module consisting of a single Yankee cylinder.

In the following, the terms "normal (drying) group" and "inverted (drying) group" are used and generally denote cylinder groups with a single-wire draw of the type mentioned above.

In the prior art, with the use of a single-wire draw in the area of the whole dryer section, various problems have occurred. The present invention is directed to providing novel and efficient solutions to these problems. These problems include the large length of the dryer section which increases the costs of the dryer section and the machine hall. Problems have also arisen from the speed difference between the paper web and the wires. This speed differential results in wear of the wires and, at an extreme, even causes a paper break in the dryer section. The use of an inverted group has also caused problems in the removal of broke which has resulted in increased break times and decreased efficiency. Generally, these problems tend to become worse as the running speeds of paper machines become higher.

OBJECTS AND SUMMARY OF THE INVENTION

Accordingly, it is an object of the present invention to provide novel solutions for the problems discussed above.

It is another object of the present invention to provide a new and improved dryer section in which the drawbacks of the prior art dryer sections are substantially eliminated.

It is a further object of the present invention to permit wider possibilities of regulation and more accurate control of the drying process in a dryer section of a paper machine.

It is yet another object of the present invention to provide a new and improved dryer section for producing a web which is sufficiently symmetric in the z-direction and which also possesses the surface properties required for uses of both sides of the paper.

In view of achieving the objects stated above and others, the drying module to be placed in the dryer section in accordance with the present invention comprises a single drying cylinder or cylinders having a heated cylinder face against which the web is placed in direct contact. The drying module also includes a separate drying-wire loop which guides the web and presses the opposite side of the web, opposite in relation to the web face placed against the drying cylinders in the normal groups. The web is pressed against the heated face of the single drying cylinder or cylinders over a sector a, whose magnitude is preferably greater than about 180°.

Drying modules in accordance with the invention may be placed in a gap or gaps between normal groups and/or, in particular cases, inside a normal group or groups between a pair of drying cylinders. Generally, the drying modules consist of one single large-diameter drying cylinder, but in other cases, especially when the drying module is placed inside a normal group, it is possible to employ more than one, preferably two, successive drying cylinders, which preferably are arranged within the same loop of a drying wire.

In a preferred embodiment of the present invention, the prior art inverted groups of drying cylinders have been replaced by a drying module which comprises a single drying cylinder having a diameter larger than the diameters of normal drying cylinders placed in the normal drying groups. In this manner, a more efficient dryer section is provided whose susceptibility of web breaks is lower when compared to the use of inverted multi-cylinder groups in the prior art. Moreover, in the event of a web break, the standstill times become shorter because the time-consuming process of cleaning the inverted multi-cylinder group is substantially omitted or the cleaning process becomes substantially quicker. In this preferred embodiment, single large cylinders can be placed, as required, in one or, preferably, in several group gaps, so that sufficiently symmetric drying of the paper web from both sides can be accomplished.

According to the present invention, a dryer section having a reduced length can be provided, whereby substantial economies can be realized in the investment costs of the dryer section as well as in the costs of the machine hall.

In the present invention, the transfers of the web from a normal group to the single large cylinder in the drying module and from the single large cylinder to another normal group can be carried out as a closed and/or open draw depending on a desired optimal operation of the drying process (so as to eliminate breaks) as well as the arrangement of the various parts and the geometry of the drying section equipment.

In addition, in the present invention, it is possible to use the steam pressure in the single large cylinders and the temperature of their cylinder faces as one parameter of regulation. In particular, the temperature of the large drying cylinder may be higher than the cylinder temperatures in the normal groups, whereby the proportion in the drying of the web of the large cylinder is kept at a sufficient and desired level. The proportion of web drying of the large cylinder is also be affected by means of the tightness of the drying wires so that, in a drying module that comprises a large cylinder, a higher wire tightness is used than in so-called normal groups.

Drying modules that include a single drying cylinder or, in other cases, drying modules that comprise several drying cylinders inside a normal group, in accordance with the invention can be placed exactly at preferred locations in view of the total circumstances of the drying process. Moreover, when the invention is applied in practice, the prior art normal groups can be modified so that, a reduced number of drying and leading cylinders and/or a smaller cylinder diameter can be employed, so that the proportion of the drying of the web carried out by means of the drying modules is brought to a sufficiently high level.

Generally, the contact cylinders and the leading cylinders are placed in normal groups in the same horizontal planes as compared with one another. However, it should be emphasized that the invention can also be applied to dryer sections in which the principal directions of the normal drying groups are inclined upwards or downwards or even vertical. Examples of such embodiments are shown in FIGS. 8, 9 and 10 in the drawings of the present application.

In the method for drying a paper web in a dryer section of a paper machine in accordance with the invention, a plurality of normal drying groups are arranged and have heated contact-drying cylinders in an upper row and leading cylinders in a lower row. A first side of the paper web is pressed by a first drying wire against heated faces of the contact-drying cylinders. A drying module is arranged between an adjacent pair of normal groups and/or inside one of the normal groups between a pair of drying cylinders. The drying module has one or more drying cylinders having a heated cylinder face. To provide symmetric dewatering of the web, a second side of the web opposite to the first side is pressed by a drying wire in the drying module against the heated cylinder face of the drying cylinder(s) in the drying module.

In the following, the invention will be described in detail with reference to some exemplifying embodiments of the invention illustrated in the figures in the accompanying drawing, the invention being by no means strictly confined to the details of the embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
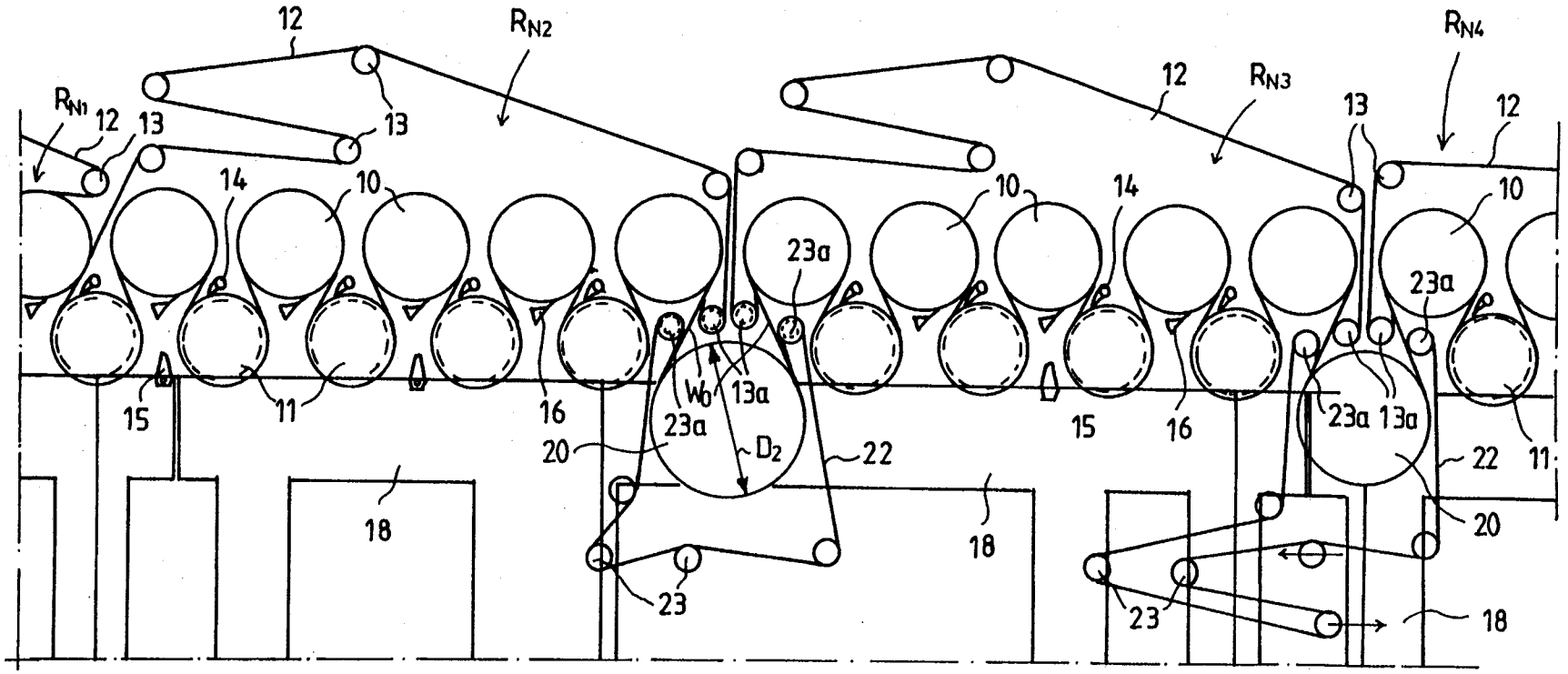
FIG. 1 is a schematic side view of a dryer section including several successive normal groups and single large cylinders arranged in a drying module between the normal groups in accordance with the present invention.

In the drying section shown in the accompanying Figures, steam-heated contact drying cylinders are denoted with reference numeral 10 and leading cylinders with reference numeral 11. Normal groups $R_N$ include an upper drying wire 12 which is guided by guide rolls 13,13a. A frame construction 18 of the dryer section is illustrated schematically. In the normal groups $R_N$, the free lower faces of the cylinders 10 are provided with doctors 16. Blow boxes 14 are arranged in the pockets above the leading cylinders 11 and blow boxes 15 are arranged in the intermediate spaces below the drying cylinders 10. The blow boxes 14,15 promote the runnability of the web and improve the evaporation of water from the web by, e.g., intensifying the ventilation of the intermediate spaces between the cylinders 10 and 11 and reducing the differences in pressure induced in the various nips in the dryer section.

On the large cylinders 20 in accordance with the present invention, one side of the web W is placed in contact with and runs against the smooth cylinder face heated to a temperature $t_1$. The other opposite side of the web W is in contact with the cylinders 10 in the normal groups $R_N$. In this manner, a sufficiently symmetrical drying of the web W, i.e., from both sides alternatingly, can be accomplished as a result of the meandering of the web over the drying cylinders in the normal group and over the large cylinder 20.

Referring to FIGS. 1 to 4, after the press section of the paper machine (not shown), there are two normal groups $R_N$ and $R_{N2}$ in the dryer section. Normal groups $R_{N1}$ and $R_{N2}$ may have the same or a different number of drying cylinders and suction rolls. The paper web W to be dried has a closed draw between these two normal groups. The number of normal groups in the dryer section may, of course, also be higher. According to the invention, between the second normal group $R_{N2}$ and third normal group $R_{N3}$ a single large cylinder 20 is arranged in conjunction with a drying wire 22 to constitute a drying module. The wire 22 presses the web W to be dried against a heated smooth cylinder face 21 of the large cylinder 20 over the sector a. In FIGS. 1 to 4, the diameter $D_2$ of the large cylinders 20 is substantially larger than the diameter $D_0$ of the steam-heated drying cylinders 10 in the normal groups $R_N$. However, in particular cases, the diameter $D_2$ of the large cylinders 20 can be substantially equal to, and in other specific cases also somewhat smaller than, the diameter $D_0$ of the drying cylinders 10. In different drying modules, it is also possible to employ large cylinders 20 having different diameters $D_2$ when compared with one another.

Other important parameters of the geometry of the drying module formed by the large cylinder 20 and the other advantageous constructional features will be described in more detail with particular reference to FIG. 2.

The large cylinder 20 is preferably a cylinder similar to a conventional drying cylinder. To manufacture the cylinder 20, it is possible to employ a technology substantially equivalent to that used for manufacturing prior art drying cylinders or corresponding Yankee cylinders. As to its construction, the large cylinder 20 may be a steel cylinder made by welding pieces of metal plate together. The tightening tension T of the loops 22 of the drying wire of the large cylinders 20 can be selected in accordance with the particular requirements of the drying to be carried out by means of the large cylinder 20, preferably so that the tension T is higher than the corresponding tension of the drying wires 12 in the normal groups $R_N$.

Referring again to FIG. 1, after the second normal group $R_{N2}$, the web W is passed on the drying wire 12 to the guide roll 13a, after which the web has a short open draw $W_0$. The web W is then transferred from wire 12 in the vicinity of a guide roll 23a onto the drying wire 22 of the large cylinder 20 and is pressed by the drying wire 22 over the sector a into direct contact with the heated cylinder face 21 of the large cylinder 20. After running over the cylinder for the length of sector a, the web W is separated from the cylinder face 21 and is transferred after the guide roll 23a as a short open draw W0, to the drying wire 12 running over the guide roll 13a. The drying wire 12 carries the web into the subsequent normal group $R_{N3}$. A corresponding single large cylinder 20 and web-transfer arrangement are provided between the normal groups $R_{N3}$ and $R_{N4}$. The remaining portion of the dryer section may either include drying modules in accordance with the invention or have standard open/closed draws between the drying groups.

The dryer section illustrated in FIG. 1 and in the other figures can be modified within the scope of the invention in several different ways. One particularly useful modification of the dryer section shown in FIG. 1 is to place the guide rolls 13a and 23a so that the open draws $W_0$ are replaced by a closed draw of the web. In addition to, or instead of, this modification, it is possible to provide the guide rolls 13a and 23a as rolls which do not have a suction zone, or even smooth-faced rolls provided with a solid mantle. These modifications can also be applied to the dryer sections shown in all of the accompanying figures.

Figure 2:
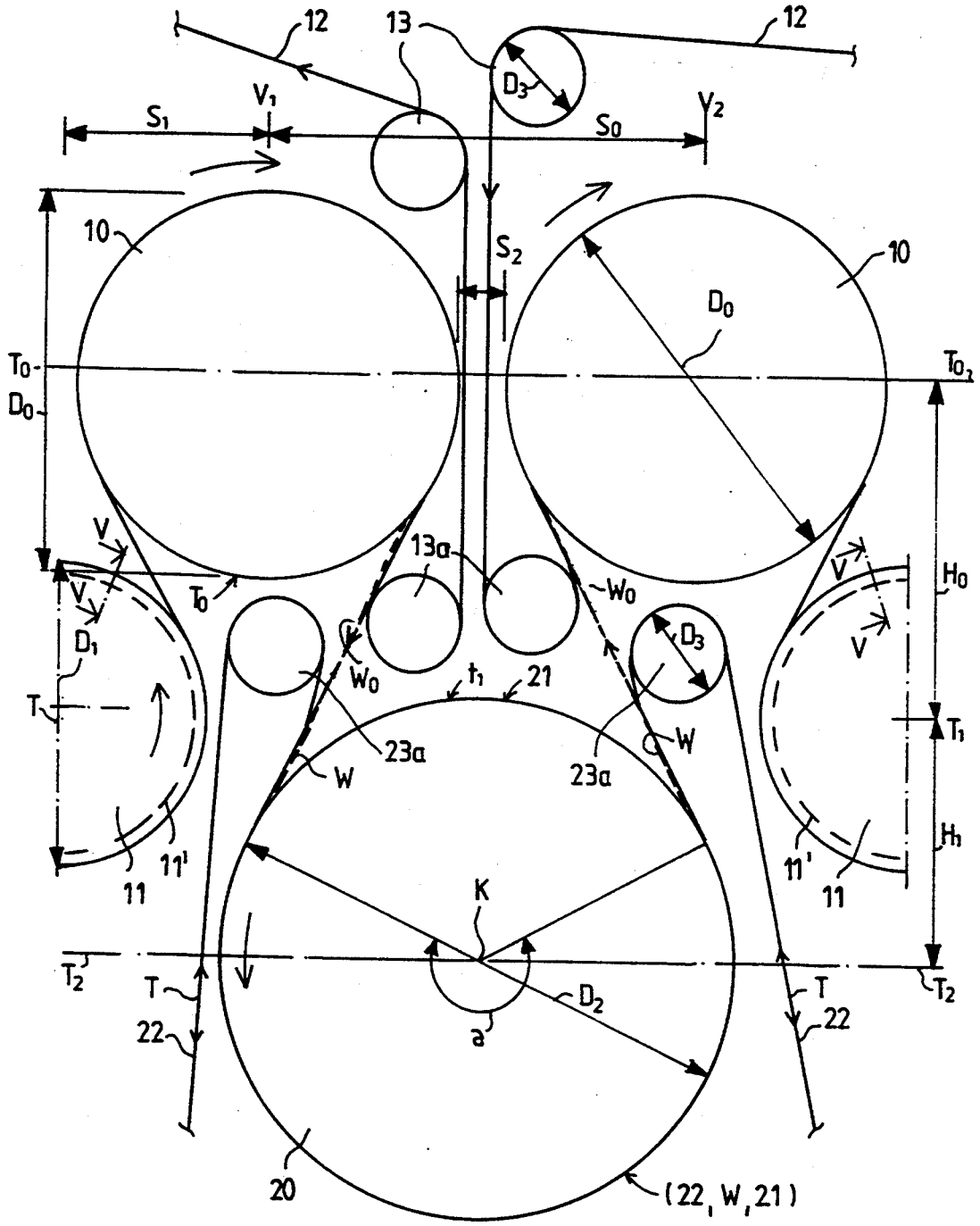
FIG. 2 is an enlarged view of the components and group-gap draws in proximity to the first large cylinder as shown in FIG. 1.

Referring to FIGS. 1 and 2, the drying groups $R_{N2}$, $R_{N3}$, $R_{N4}$, . . . are arranged so that the horizontal distance $S_2$ between adjacent drying cylinders 10 in successive groups $R_{N2}$–$R_{N3}$, $R_{N3}$–$R_{N4}$, . . . is substantially equal to the horizontal distance between adjacent drying cylinders 10 inside the normal groups $R_N$. The distance $S_2$ is typically in a range from about 150 mm to about 500 mm. In this manner, it is possible to provide a very compact dryer section which is substantially shorter when compared with the use of inverted multi-cylinder groups in prior art dryer section arrangements.

Thus, the present invention provides a significant advantage over prior art dryer sections in which it was necessary to arrange inverted drying groups with their corresponding large length in order to provide a symmetric drying of the web.

Figure 3:
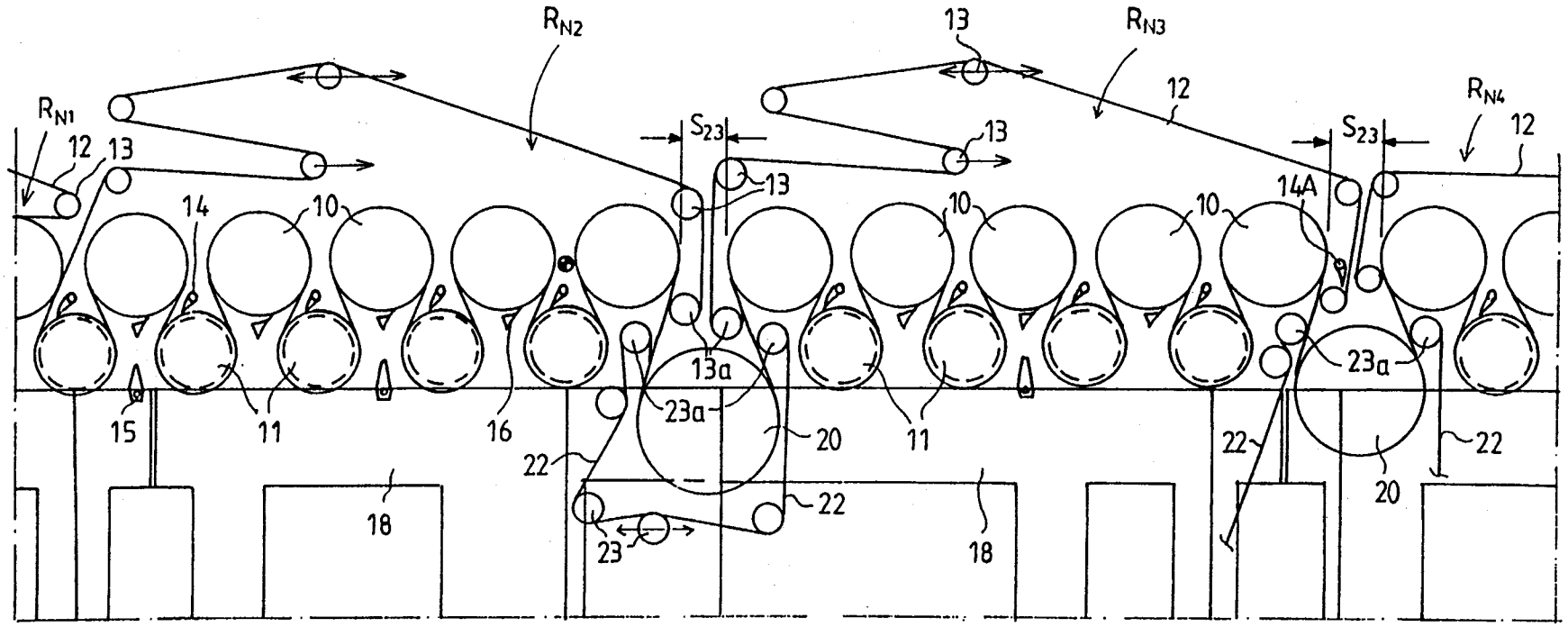
FIG. 3 shows a schematic side view of a second embodiment of a dryer section including several successive normal groups and single large cylinders arranged in a drying module between the normal groups in accordance with the present invention.

FIG. 3 shows an embodiment of the invention in which the horizontal distance $S_{23}$ is substantially larger than $S_2$, typically $S_{23}$ is $(2-3)\times S_2$. In such a case, the dryer section becomes somewhat longer, but, at the same time, more space becomes available for the guide rolls 13*a*, 23*a* and, if necessary, also for blow boxes or equivalent, which are represented by the blow box 14A in FIG. 3. In this embodiment, the blow box 14A can be arranged to direct air blowings to assist in the detachment of the web from the drying wire.

Figure 4:
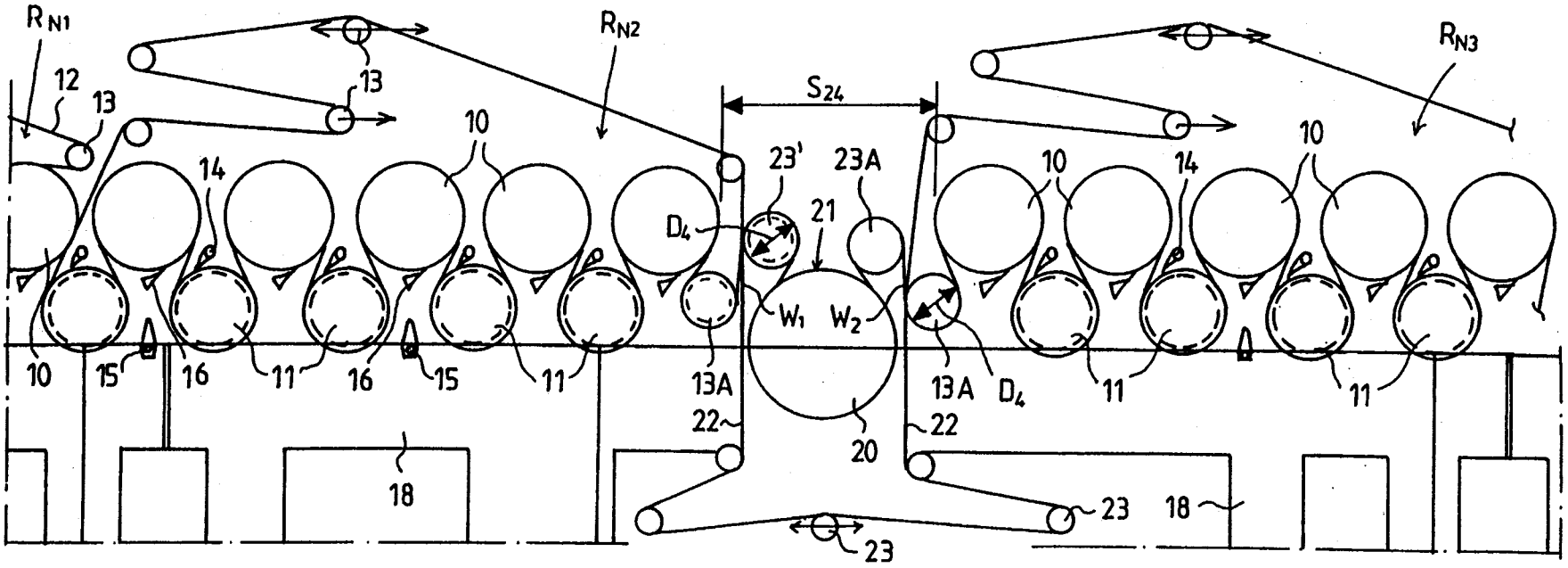
FIG. 4 shows a schematic side view of a third embodiment of a dryer section including several successive normal groups and single large cylinders arranged in a drying module between the normal groups in accordance with the present invention.

FIG. 4 illustrates an embodiment of the invention in which the horizontal distance $S_{24}$ between adjacent cylinders 10 in successive groups $R_N$ at the large cylinder 20 is substantially larger than in the embodiments shown in FIGS. 1 to 3, preferably $S_{24}$ is about $(3-8)\times S_2$. In this embodiment, in connection with the web transfer in the group gap (the gap between adjacent groups), it is possible to use guide rolls and/or suction rolls having a diameter ($D_4$) larger than that of normal guide rolls 13, 23, e.g., guide rolls 13A and 23A shown in connection with the wires 12 and 22. The guide rolls and/or suction rolls 13,23 can be provided with suction means, e.g., internal suction boxes and appropriately placed suction zones, to ensure an undisturbed transfer of the web W at the group gaps even at high web running speeds. In addition, as the guide rolls 13A and 23A, it is also possible to use leading cylinders marketed by the assignee under the trade mark "VAC-Roll".

Referring to FIG. 4, in this embodiment, the draws $W_1$ and $W_2$ at the group gaps are fully closed so that the web W is transferred from the preceding wire 12 onto the wire 22 of the single large cylinder 20 as a fully closed draw $W_1$. A corresponding closed draw $W_2$ is provided at the outlet side of the wire 22 so that the web is transferred from the large cylinder 20 onto the wire 12 of the group $R_{N3}$. The diameter $D_4$ of the guide rolls 13A,23A is typically in a range from about 600 mm to about 1500 mm. The dryer section construction as shown in FIG. 4 is also advantageous because, as a result of the relatively wide open space $S_{24}$, the upper area of the single large cylinder 20 is accessible. The removal of broke through this open space $S_{24}$ is rapid and the transfer of the web at the group gaps is highly reliable and undisturbed.

In the following description, and as used above, for the sake of conciseness, the leading cylinders 11 refer to suction cylinders or rolls against which the drying wire 12 enters into direct contact while the web W is placed at the side of the outside curve. The leading cylinders 11 are placed inside the loops of the drying wire 12 and the drying cylinders 10 are arranged outside the loop of the drying wire 12. Even though the designation "leading cylinder 11" is used, in some cases the leading cylinders can be replaced by rolls having a smaller diameter. One example of such a substitute roll are leading suction rolls provided with an internal suction box.

Figure 5:
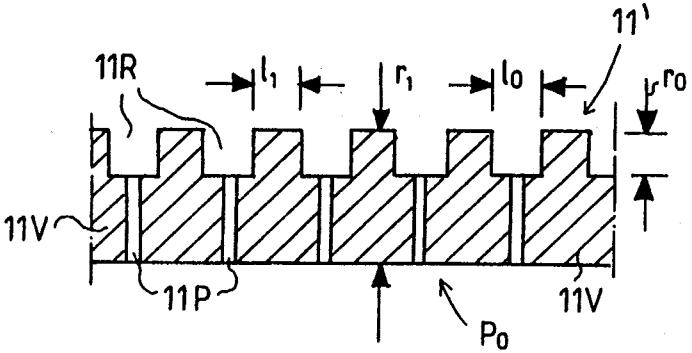
FIG. 5 illustrates axial sectional views of the mantle of a leading cylinder at the planes V—V shown in FIG. 2.

With some exceptions, in the present invention the leading cylinders 11 are preferably leading cylinders marketed by the assignee under the trade mark "VAC-Roll" (wherein the diameter $D_2$ is about 1500 mm). As shown in FIG. 5, these leading cylinders have a perforated mantle 11V having a grooved outside face 11' and an interior region which communicates with a source of negative pressure $p_o$. The web W is held on the turning sectors of the leading cylinders 11 by means of the difference in pressure produced by the negative pressure.

FIG. 5 shows axial sectional views of the mantle 11V of the leading suction roll 11 taken along the plane V—V in FIG. 2. The grooved face 11' in the mantle 11V consists of annular grooves 11R passing around the mantle. The depth of the grooves is denoted by $r_o$, the width of the groove is denoted by $l_o$, and the width of the mantle portions of full wall thickness between the grooves is denoted by $l_1$. The perforations or holes 11P that pass through the mantle 11V are opened into the bottom portion of the grooves 11R. The diameter of the holes is denoted with $\phi$, and the full thickness of the mantle 11V is denoted by $r_1$.

In the following, a preferred example of the dimensions of a grooved mantle as shown in FIG. 5 will be given: $r_o$ is about 4 mm, $l_o$ is about 5 mm, $r_1$ is about 30 mm, $l_1$ is about 16 mm and $\phi$ is about 4 mm. The spacing and the diameters $\phi$ of the perforations 11P are selected so that the percentage of the holes in the total area of the bottom of the grooves 11R is from about 0.5% to about 2.5%. The negative pressure $p_o$ is preferably in a range from about 1 kPa to about 5 kPa.

With respect to other constructional details of the VAC-Rolls, reference is made to the assignee's Finnish Patent No. 83,680 (corresponding to U.S. Pat. No. 5,172,491, the specification of which is incorporated by reference herein).

In the following, with reference to FIG. 2, important parameters of the construction and dimensions of a drying module consisting of a large cylinder as shown in FIGS. 1 to 4, and preferred exemplifying embodiments of the same, will be described.

The diameter $D_2$ of the single large cylinder 20 in the drying modules is substantially larger than the diameter $D_0$ of the drying cylinders 10, e.g., $D_2$ is about $(1.1-2)\times D_0$, preferably from about 1.2 to about 1.7 times $D_0$. Typically, the diameter $D_0$ is about 1800 mm and diameter $D_2$ is about 1500 mm (between 1700 mm and 2000 mm), in which case diameter $D_2$ is preferably dimensioned in a range from about 2000 mm to about 3000 mm (or even 3500 mm). Diameter $D_3$ of the guide rolls 13 of the wires 12,22 is generally from about 500 mm to about 800 mm.

In FIGS. 1 to 6, the cylinders 10 in the normal groups $R_N$ are placed in the same horizontal plane $T_0$—$T_0$ in all of the groups and the leading cylinders 11 are placed in the same horizontal plane $T_1$—$T_1$ in relation to each other. The difference in height $H_0$ between the horizontal planes $T_0$ and $T_1$ is generally from about 900 mm to about 1800 mm. In the embodiment of FIG. 2, the centers K of the single large cylinders 20 in the drying modules are placed at a height level in plane $T_2$—$T_2$ which is considerably lower than the plane $T_1$—$T_1$. With the dimensioning of the cylinders 10, 11 and 20 as described above, the difference in height $H_1$ between the planes $T_1$ and $T_2$ is typically from about 0 mm to about 1500 mm depending primarily on the diameter of the large cylinder 20 and on the web-draw geometry used in the dryer section. The preferred range of height difference between planes $T_1$ and $T_2$ is from about 300 mm to about 1500 mm. The shortest horizontal distance $S_2$ between adjacent cylinders 10 is, in a preferred embodiment, substantially equal to the distance between the cylinders 10 in the normal groups $R_N$.

In another embodiment, the guide rolls 13A and 23A of the wires 12 and 22 are placed in substantially the same horizontal plane or at a slight relative difference in height, depending on what is required by an optimal transfer of the web in the group gaps.

The evaporation capacity of the single large cylinders 20 is not only affected by the cylinder diameter $D_2$, but is also affected by the magnitude of the covering sector a of the web W. Sector a is generally selected in a range from about 180° to about 300°, preferably between about 220° and about 270°. Moreover, the drying capacity of the large cylinders 20 can be influenced by means of the temperature $t_1$ of the face 21 of the cylinder 20. Temperature $t_1$ is arranged to be somewhat higher than the corresponding surface temperature of the cylinders 10. This is achieved, for example, by using a higher steam pressure in the large cylinders 20 than in the cylinders 10 in the normal groups $R_N$.

The drying process and the transverse shrinkage of the web on the large cylinder 20 can also be affected to some extent by means of the structure of the wire 22, in particular by its permeability and its tension T. The tension T of the wire 22 is selected to be slightly higher than the tension of the wires 12, usually in a range from about 2 kN/m to about 5 kN/m.

The construction shown in FIG. 2 is preferably symmetric in relation to a vertical plane arranged transverse to the machine direction and through a center K of the single large cylinder 20.

In the embodiments of the present invention shown in FIGS. 1 to 4, the drying modules have a single large-diameter drying cylinders 20 placed over the length of the dryer section in the vicinity of, or exactly at, the points at which it is most advantageous in view of the completeness of the drying process. Typically, in a fine-paper or newsprint machine, there are between 6 and 9 normal groups $R_N$ and therefore, between 2 and 3 drying modules in accordance with the invention. The drying modules are placed, e.g., in the gaps between the normal groups in the rear end of the dryer section.

If the proportion of the evaporation taking place from the different faces of the web W in the drying modules in accordance with the invention cannot be controlled to a sufficient extent by the means described above, i.e., by means of the dimensioning of the diameter $D_2$ and the covering sector a of the single cylinders 20, the wire 22 tension, and/or by the selection of an appropriate temperature t1 of the cylinder 20 faces, then the drying proportion may be increased further by using normal groups $R_N$ which are shorter than normal. In such short normal groups, there are only about 2 to about 4 drying cylinders as opposed to usual amount of about 5 or 6. Instead of, or in addition to, the above-mentioned means, it is possible, in the normal groups $R_N$ to use a smaller diameter $D_0$ of a drying cylinder than that stated above, e.g., by dimensioning $D_0$ to be in a range from about 1500 mm to about 1750 mm.

Figure 6:
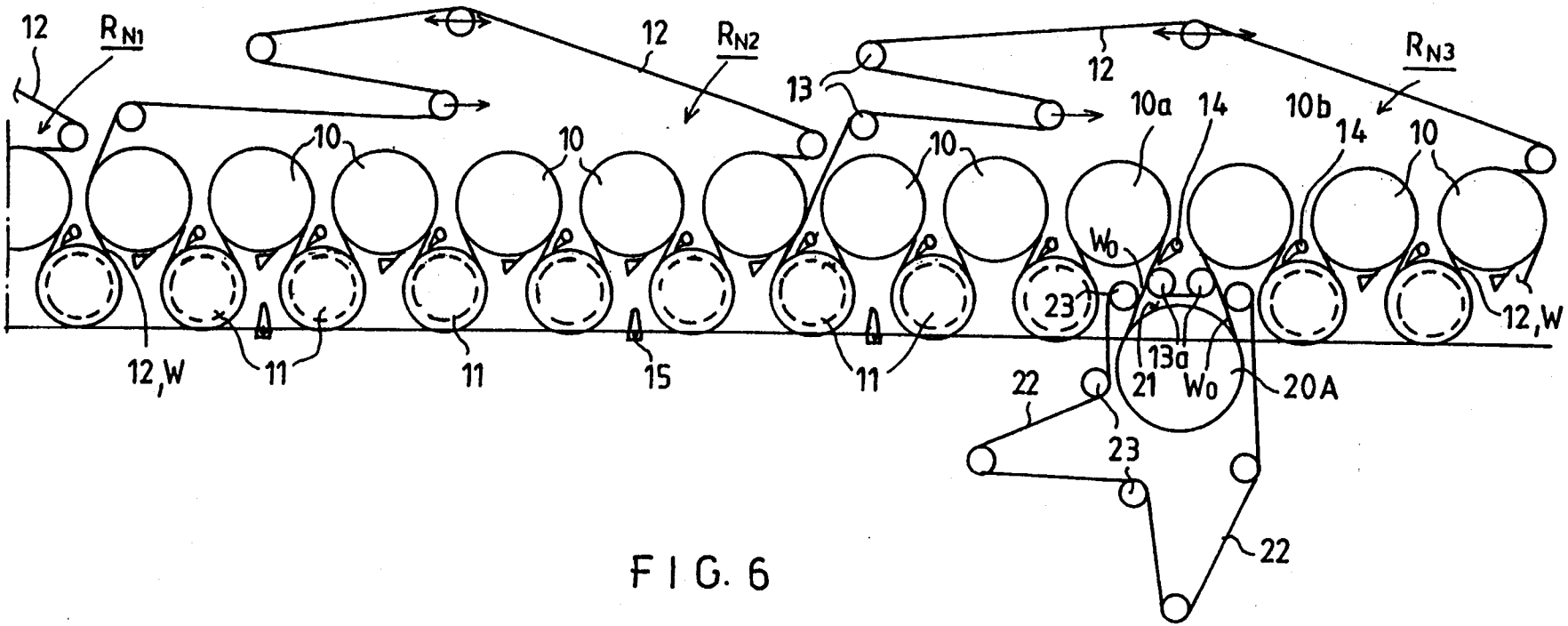
FIG. 6 shows an embodiment of the present invention in which a drying module that comprises a single large cylinder is placed inside a normal group between a pair of drying cylinders.

FIG. 6 shows an alternative embodiment of the present invention in which the dryer section does not include a drying module between the successive normal groups $R_N$, $R_{N2}$ and $R_{N31}$. Rather, the web has a closed draw between the successive normal groups $R_N$, $R_{N2}$ and $R_{N31}$. Instead of arranging the drying module between the drying groups, a drying module in accordance with the present invention is arranged inside the normal group $R_{N31}$, and includes a large cylinder 20A having a heated face 21 against which the opposite face of the web W is placed (opposite in relation to the web face placed in contact with the drying cylinders 10 in the normal groups $R_N$).

From the drying cylinder **10*a* of the normal group $R_{N31}$, the web W arrives as a short open draw W0 onto the large cylinder 20A and is, in a corresponding way, transferred from the large cylinder 20A as a short open draw $W_0$ onto the drying wire 12 of the group $R_{N31}$ at the guide roll 13*a*. From the guide roll 13*a*, the web is transferred further onto the drying cylinder 10*b* and proceeds through the group $R_N$ on support of the same drying wire 12. In addition to the drying module 20A-23 arranged inside the normal group $R_{N31}$, drying modules as shown in FIGS. 1 to 4** may be arranged in the group gaps between the normal groups $R_{N1}$, $R_{N2}$ and $R_{N31}$. In connection with the drying module arranged inside the normal group $R_{N31}$, it is also possible to employ a closed draw of the web W without an open gap.

Figure 7:
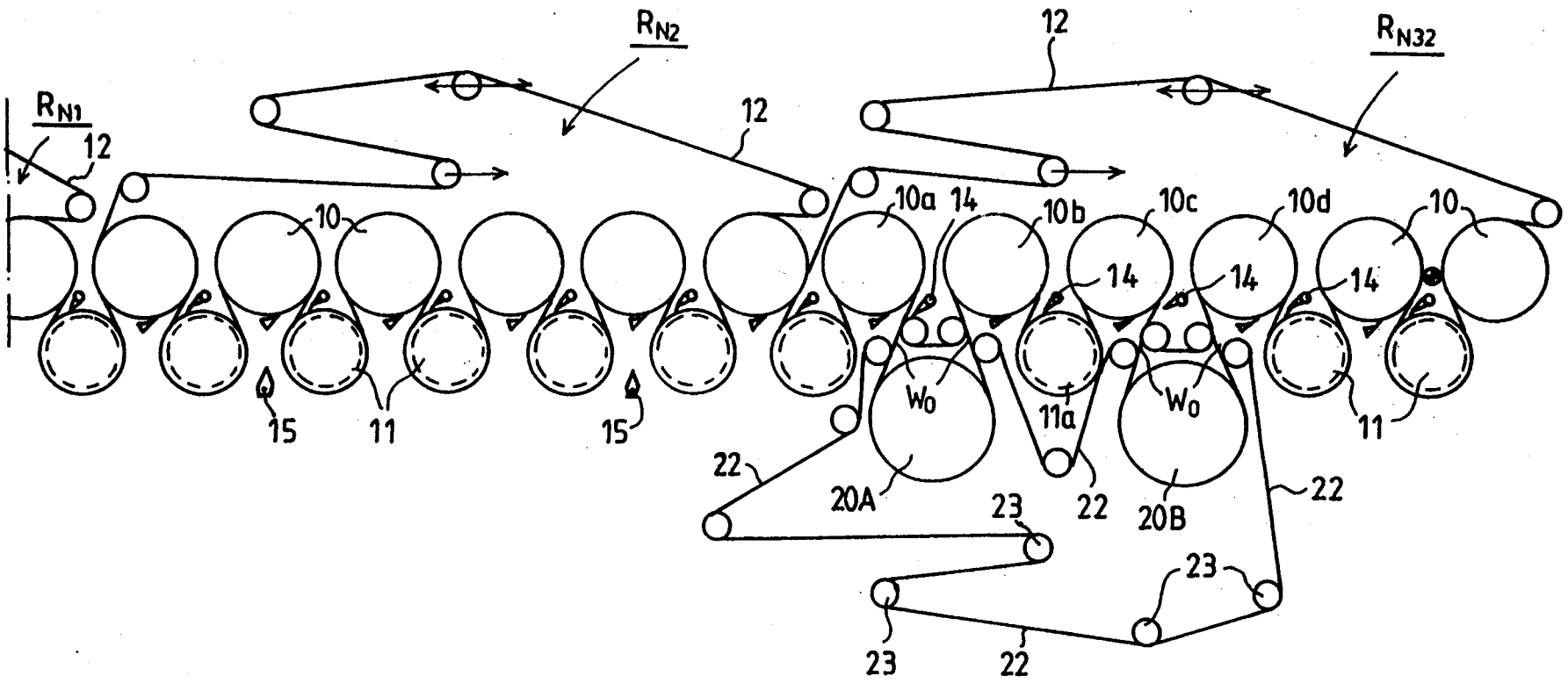
FIG. 7 shows an alternative to the embodiment shown in FIG. 6, in which a drying module arranged inside a normal group and between a pair of drying cylinders comprises two large cylinders placed inside the same wire loop.

FIG. 7 shows a dryer section similar to that shown in FIG. 6 wherein the same reference numerals refer to the same elements as described above with reference to the embodiment of FIG. 6. One particular difference between the embodiments of FIG. 6 and FIG. 7 is that a drying module is arranged inside the drying group $R_{N32}$ which includes two large cylinders 20A and 20B that have a common drying wire 22. Inside the normal group $R_{N32}$, the web W is transferred from the drying cylinder **10*a* as a short open draw $W_0$ onto the first large cylinder 20A and from the first large cylinder 20A onto the next drying cylinder 10*b*. The web W is transferred from the drying cylinder 10*b* and guided by the leading cylinder 11*a* onto the next drying cylinder 10*c*. From the drying cylinder 10*c*, the web W is transferred as a short open draw $W_0$ onto the second large cylinder 20B, which has a common wire 22 with the first large cylinder 20A. After this transfer onto the cylinder 20B, the web W is transferred as a short open draw $W_0$ onto the drying cylinder 10*d* and further on support of the drying wire 12** of the group $R_{N32}$.

The normal group $R_{N32}$ shown in FIG. 7 is different than that contained in a prior art dryer section provided with twin-wire draw because, after the first large cylinder 20A, the web W runs over two contact-drying cylinders **10*b* and 10*c* and over the leading cylinder 11*a* placed between them before it arrives on the second large cylinder 20B. It is a further difference that the diameter $D_2$ of the large cylinders 20A and 20B is larger than the diameter of the contact-drying cylinders 10 and that the large cylinders 20A and 20B are placed at a height level which is lower than the level of the leading cylinders 11. In connection with an embodiment as shown in FIG. 7, a drying module of the type in accordance with the present invention, e.g., as shown in FIGS. 1 to 4**, can be used in one or several group gaps between the groups $R_N$, $R_{N2}$ and/or $R_{N32}$.

The scope of the present invention also includes different combinations of the embodiments illustrated in FIGS. 1 to 4 and in FIGS. 6 and 7 in which large cylinders 20,20A are placed both in a group gap and inside a group. Each of the large cylinders is provided with a drying wire 22 of its own, or, alternatively, the large cylinders 20,20A are provided with a common drying wire 22 in a manner corresponding to the large cylinders 20A and 20B in the arrangement shown in FIG. 7.

Figure 8:
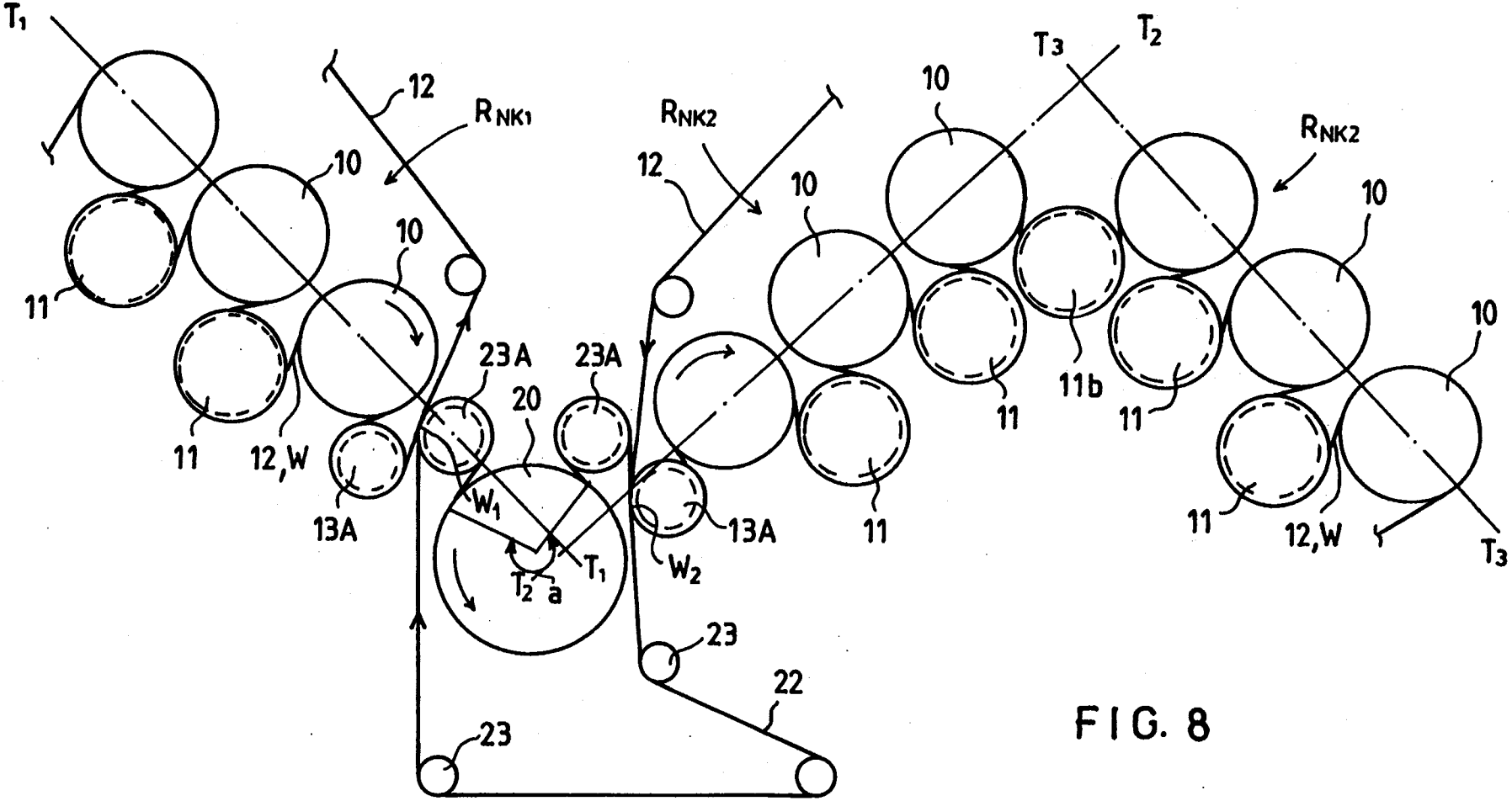
FIG. 8 shows an embodiment of the present invention in which a drying module that comprises a single large cylinder is placed between two successive normal groups, of which groups the former one has a rear half whose principal direction is inclined downwards, whereas the latter one has a forward half that is inclined upwards.

In FIG. 8, a particular dryer section in accordance with the invention is shown in which the main directions, i.e., orientation in planes $T_1$—$T_1$, $T_2$—$T_2$ and $T_3$—$T_3$3 , of the normal groups $R_{NK1}$ and $R_{NK2}$ are inclined. In the group gap between the normal groups $R_{NK1}$ and $R_{NK2}$, there is a drying module in accordance with the invention, which includes a large cylinder 20, a wire 22 guided by the guide rolls 23 and 23A and arranged so that the web W has a closed draw $W_1$ to the drying module and a corresponding closed draw $W_2$ from the wire 22 onto the wire 12 of the group $R_{NK2}$. The embodiment shown in FIG. 8 is in the other respects similar to that shown in FIG. 4. However, the plane $T_1$—$T_1$ placed through the centers of the cylinders 10 in the rear end of the preceding normal group $R_{NK1}$ is inclined downwards and, in a corresponding manner, the main direction $T_2$—$T_2$ of the initial part of the latter drying group $R_{NK2}$ is inclined upwards. The main direction of the rear part of the drying group $R_N$K2 is converted at the leading cylinder **11*b*** into a downwards inclined direction $T_3$—$T_3$, which is preferably parallel to the plane $T_1$—$T_1$.

The embodiment shown in FIG. 8, and also the embodiments shown in FIGS. 9 and 10 to be described in detail below, has a significant advantage in that the length of the dryer section in the machine direction can be reduced further because an increased drying capacity can be arranged within a meter of length in the machine direction.

Figure 9:
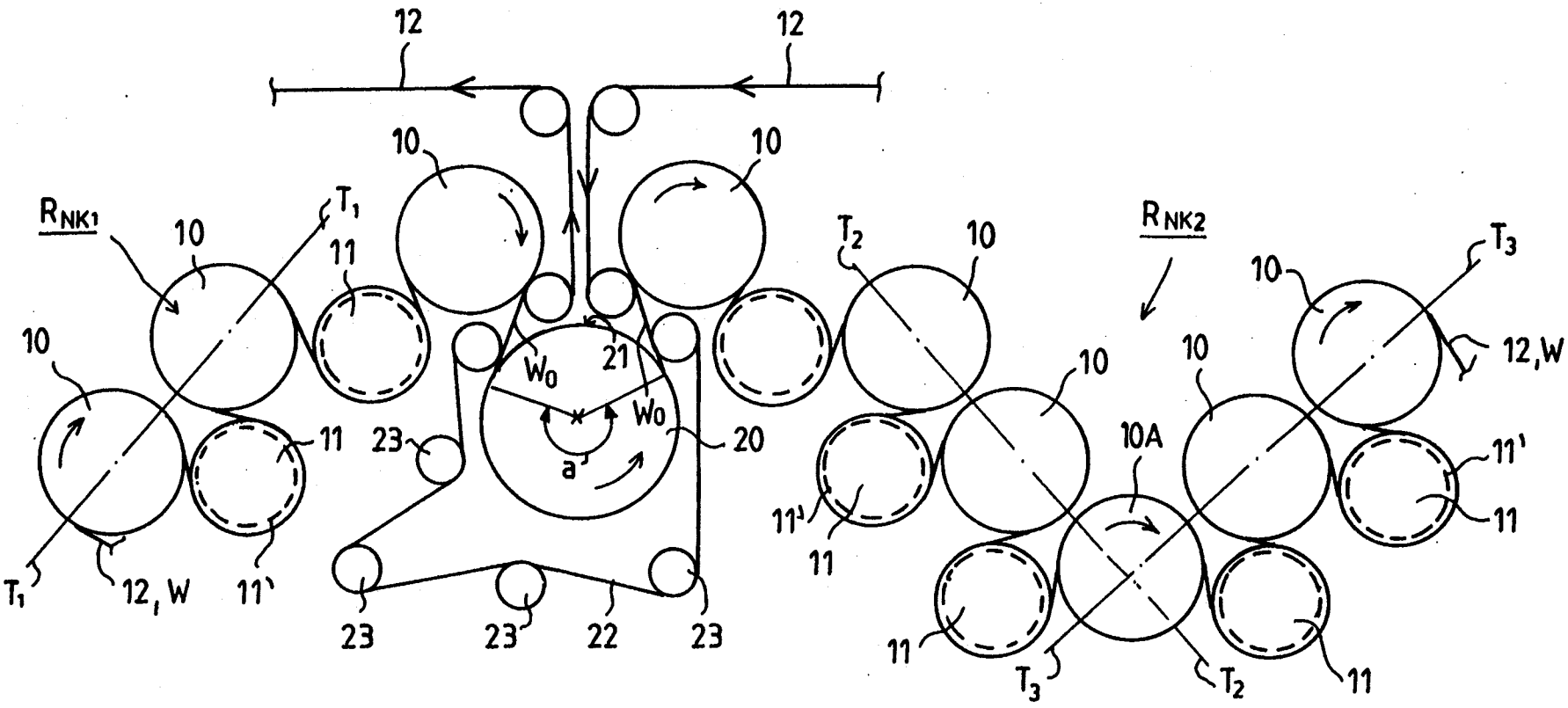
FIG. 9 shows an alternative to the embodiment shown in FIG. 8, in which the rear half of the former normal group has a principal direction that is inclined upwards, whereas the forward half of the latter normal group has a principal direction that is inclined downwards.

The embodiment shown in FIG. 9 is in other respects similar to that shown in FIG. 8 wherein the same reference numerals refer to the same elements as described above. One particular difference is that the main direction $T_1$—$T_1$ of the rear part of the preceding normal group $R_{NK1}$ is inclined upwards, and the direction $T_2$—$T_2$ of the initial part of the drying group $R_{NK2}$ is, in a corresponding manner, inclined downwards. The final part of the drying group $R_{NK2}$ is turned in the area of the cylinder 10A into an upwards inclined direction $T_3$—$T_3$. In FIG. 9, a further difference in comparison to the embodiment of FIG. 8 is that, instead of a closed draw, the web W has short open draws $W_0$ when it arrives on and departs from the large cylinder 20.

Figure 10:
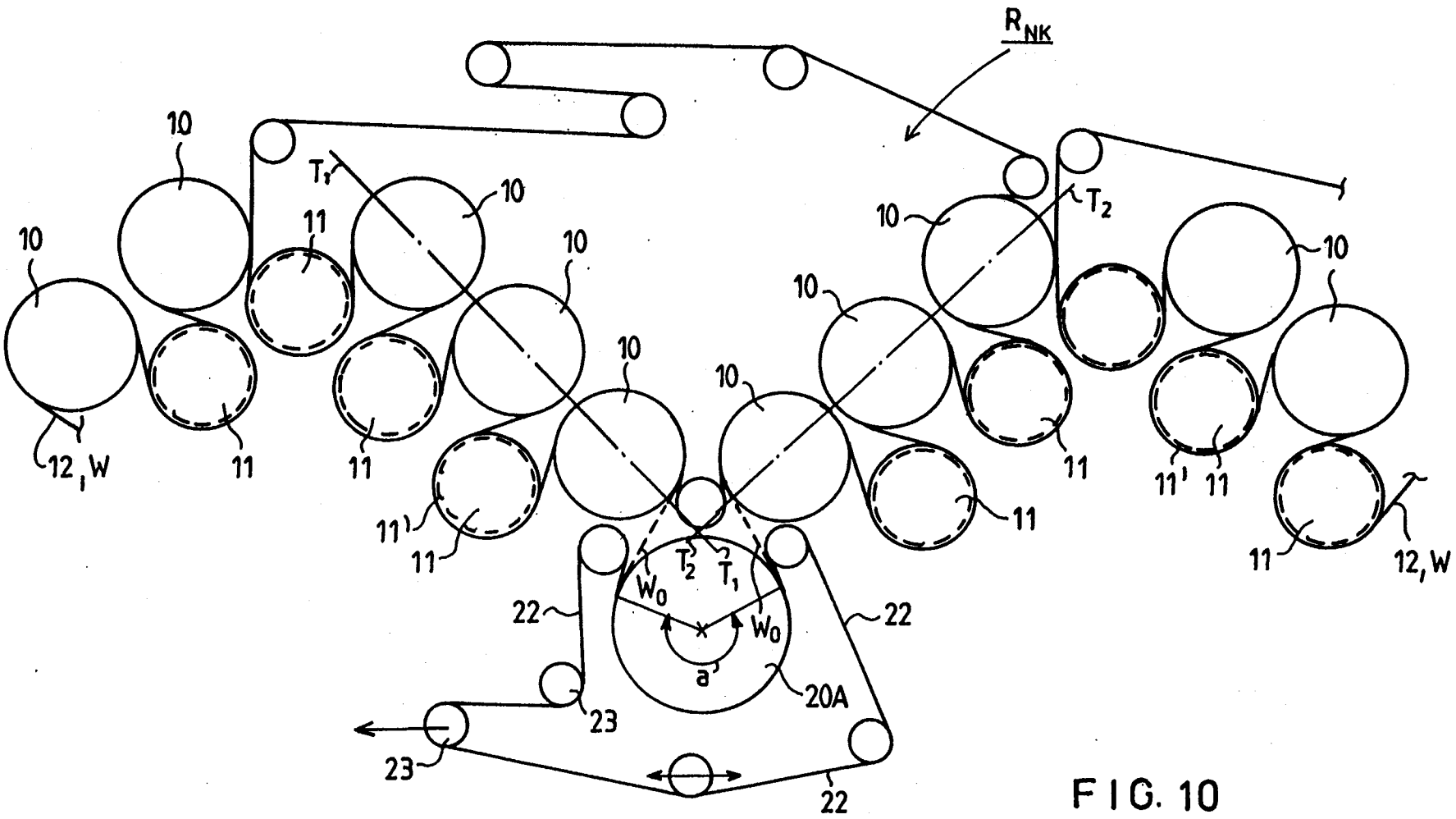
FIG. 10 shows an embodiment in which a drying module in accordance with the invention is placed inside a normal group between a pair of drying cylinders which has a forward part that is inclined downwards and a rear part that is inclined upwards.

FIG. 10 shows a dryer section that is in other respects similar to that shown in FIG. 8 wherein the same reference numerals refer to the same elements as described with reference to FIG. 8. However, in the embodiment of FIG. 10, the large cylinder 20A is arranged inside the normal group $R_{NK}$ so that the normal group $R_{NK}$ includes an initial part that is placed before the large cylinder 20A. The main direction $T_1$—$T_1$ is inclined downwards and a corresponding rear part, placed after the large cylinder 20A, has a main direction $T_2$—$T_2$ inclined upwards. Thus, the web W runs first as an open draw $W_0$ onto the large cylinder 20A and returns from it also as an open draw $W_0$ onto the same wire 12 in the normal group $R_{NK}$ from which it departed onto the large cylinder 20A. In other respects, the construction illustrated in FIG. 10 is similar to that described above.

The scope of the invention also includes such modifications as shown in FIGS. 8 to 10 in which the directions of the planes $T_1$—$T_1$, $T_2$—$T_2$ and $T_3$—$T_3$ may be even vertical or almost vertical.

The examples provided above are not meant to be exclusive. Many other variations of the present invention would be obvious to those skilled in the art, and are contemplated to be within the scope of the appended claims.

We claim:

1. Dryer section of a paper machine, comprising a plurality of normal drying groups having heated contact-drying cylinders arranged in an upper row and leading cylinders arranged in a lower row, a first side of a paper web being pressed against heated faces of said contact-drying cylinders by a respective first drying wire in each of said normal drying groups, and at least one drying module arranged in a respective gap between an adjacent pair of said normal drying groups, said drying module comprising a single drying cylinder having a heated cylinder face and a respective second drying wire arranged in a loop which guides the web and presses a second side of the web opposite to said first side of the web against said heated cylinder face over a sector of said single drying cylinder, said sector having a magnitude greater than about 180°.

2. Dryer section of claim 1, further comprising at least one additional drying module arranged between a respective pair of adjacent ones of said contact-drying cylinders in one of said plurality of normal drying groups, said at least one additional drying module comprising at least one drying cylinder having a heated cylinder face and a drying wire arranged in a loop which guides the web and presses said second side of the web against said heated cylinder face over a sector of said at least one drying cylinder, said sector having a magnitude greater than about 180°.

3. Dryer section of claim 2, wherein said at least one additional drying module comprises first and second drying cylinders over which said drying wire in said at least one additional drying module runs, each of said first and second drying cylinders in said at least one additional drying module being arranged between an adjacent pair of said contact-drying cylinders in said one of said normal drying groups.

4. Dryer section of claim 3, wherein the web is transferred from said first drying cylinder in said at least one additional drying module to a first one of said contact-drying cylinders in said one of said normal drying groups and runs over one of said leading cylinders arranged between said first contact-drying cylinder and a second one of said contact-drying cylinders in said one of said normal drying groups, the web being transferred from said second contact-drying cylinder in said one of said normal drying groups to said second drying cylinder in said at least one additional drying module and from said second drying cylinder in said at least one additional drying module to additional contact-drying cylinders in said one of said normal drying groups.

5. Dryer section of claim 2, wherein said second drying wire constitutes the drying wire in said at least one additional drying module.

6. Dryer section of claim 1, wherein the diameter of said single drying cylinder is substantially larger than the diameter of said contact-drying cylinders.

7. Dryer section of claim 1, wherein the diameter of said single drying cylinder is from about 1.1 to about 2 times the diameter of said contact-drying cylinders.

8. Dryer section of claim 7, wherein the diameter of said single drying cylinder is from about 1.2 to about 1.7 times the diameter of said contact-drying cylinders.

9. Dryer section of claim 1, wherein the dryer section comprises first, second and third successively arranged normal drying groups, the web running as a closed draw between said first and second normal drying groups, said drying module comprising one drying cylinder and being arranged between said second and third normal drying groups.

10. Dryer section of claim 1, wherein said contact-drying cylinders have a pressure in an interior thereof and a surface temperature, the temperature of said heated cylinder face of said single drying cylinder being higher than the corresponding surface temperature of said contact-drying cylinders in said normal drying groups, said single drying cylinder having a higher steam pressure therein than the steam pressure in said contact-drying cylinders to thereby produce the higher temperature.

11. Dryer section of claim 1, wherein the center of rotation of said single drying cylinder is arranged at a lower height than the center of rotation of said leading cylinders, the difference in height between said single drying cylinder and said leading cylinders being from about 300 mm to about 1500 mm.

12. Dryer section of claim 1, wherein said at least one drying module comprises first and second drying modules, said plurality of normal drying groups comprising consecutively arranged first, second and third normal drying groups, wherein said first drying module is arranged between said first and second normal drying groups and said second drying module is arranged between said second and third normal drying groups.

13. Dryer section of claim 1, wherein said contact-drying cylinders in said upper row of said normal drying groups are arranged in at least one of the same horizontal plane, different inclined planes and vertical planes.

14. Dryer section of claim 1, wherein the web has closed draws or short open draws between adjacent ones of said normal drying groups and between said normal drying groups and said single drying cylinder.

15. Dryer section of claim 1, wherein said leading cylinders in said normal drying groups have a perforated mantle and an outer grooved face, an interior portion of said leading cylinders being connected to a source of negative pressure without an internal suction box, such that negative pressure in said grooved face holds the web on said first drying wire.

16. Dryer section of claim 1, wherein said leading cylinders are suction rolls having a perforated outer mantle and an internal suction box.

17. Dryer section of claim 1, wherein the sector of contact of the paper web on said single drying cylinder is from about 220° to about 270°.

18. Dryer section of claim 1, wherein said second drying wire has a higher tensioned tightness than the tensioned tightness of said first drying wire in said normal drying groups.

19. Dryer section of claim 1, wherein the horizontal distance between adjacent ones of said contact-drying cylinders in successively arranged normal drying groups is substantially equal to the corresponding horizontal distance between adjacent ones of said contact-drying cylinders arranged in said normal drying groups.

20. Dryer section of claim 1, wherein the horizontal distance between adjacent ones of said contact-drying cylinders in successively arranged normal drying groups is from about 2 to about 7 times larger than the corresponding horizontal distance between adjacent one of said contact-drying cylinders arranged in said normal drying groups.

21. Dryer section of claim 1, wherein said at least one drying module is placed in a group gap between a first and second one of said normal drying groups, the dryer section further comprising first guide rolls arranged to transfer the web between said at least one drying module and said first drying wire in said normal drying groups, and second guide rolls arranged in a loop of said first drying wire and a loop of said second drying wire, the diameter of said first guide rolls being substantially larger than the diameter of said second guide rolls, and said first guide rolls being selected from a group consisting of rolls having a grooved mantle, rolls having a perforated mantle, suction rolls having a grooved mantle and suction rolls having a perforated mantle.

22. Dryer section of claim 1, further comprising blow boxes arranged to promote support contact between the web and said first drying wire.

23. Dryer section of claim 1, wherein the diameter of said single drying cylinder is from about 2000 mm to about 3500 mm, and the diameter of said contact-drying cylinders is from about 1700 mm to about 2000 mm.

24. Dryer section of claim 1, wherein said each of said adjacent pair of said normal drying groups comprises three or four of said contact-drying cylinders to ensure an adequate proportion of the drying on said single drying cylinder.

25. Dryer section of claim 24, wherein the diameter of said three or four contact-drying cylinders is from about 1500 mm to about 1750 mm.

26. Dryer section of claim 1, further comprising wire-guide rolls for transferring the web as a closed draw between said at least one drying module and said first drying wire in said first and second normal drying groups, said wire-guide rolls being selected from a group consisting of solid-mantle rolls and smooth-faced wire-guide rolls without any suction.

27. A method for drying a paper web in a dryer section of a paper machine, comprising the steps of:

arranging a plurality of normal drying groups in a dryer section such that heated contact-drying cylinders are located in an upper row and leading cylinders are located in a lower row, pressing a first side of the paper web against heated faces of said contact-drying cylinders by a respective first drying wire in each of said normal drying groups, arranging at least one drying module in the dryer section, said drying module comprising a single drying cylinder having a heated cylinder face, and pressing a second side of the web opposite to said first side against said heated cylinder face of said single drying cylinder of said drying module, the second side of the web being pressed by a respective second drying wire over a sector of said single drying cylinder, said sector having a magnitude greater than about 180°.

28. The method of claim 27, further comprising arranging said at least one drying module between a first one of said normal drying groups and a second one of said normal drying groups.

29. The method of claim 28, further comprising arranging said first normal drying group in a principal direction inclined downward, arranging said second normal drying group in a principal direction inclined upward, and arranging said drying module between said first normal drying group and said second normal drying group.

30. The method of claim 28, further comprising the step of arranging at least one additional drying module between a respective pair of adjacent ones of said drying cylinders in one of said normal drying groups.

31. The method of claim 27, further comprising arranging said at least one drying module between a respective pair of adjacent ones of said drying cylinders in one of said normal drying groups.

32. Dryer section of a paper machine, comprising a plurality of normal drying groups having heated contact-drying cylinders arranged in an upper row and leading cylinders arranged in a lower row, a first side of a paper web being pressed against heated faces of said contact-drying cylinders by a respective first drying wire in each of said normal drying groups, and at least one drying module arranged between a respective pair of adjacent ones of said contact-drying cylinders, said drying module comprising a single drying cylinder having a heated cylinder face and a respective second drying wire arranged in a loop which guides the web and presses a second side of the web opposite to said first side of the web against said heated cylinder face over a sector of said single drying cylinder, said sector having a magnitude greater than about 180°.

33. Dryer section of a paper machine, comprising a plurality of normal drying groups having heated contact-drying cylinders arranged in an upper row and leading cylinders arranged in a lower row, a first side of a paper web being pressed against heated faces of said contact-drying cylinders by a respective first drying wire in each of said normal drying groups, and at least one drying module comprising only first and second drying cylinders having a heated cylinder face and a respective second drying wire arranged in a loop which guides the web and presses a second side of the web opposite to said first side of the web against said heated cylinder face over a sector of each of said first and second drying cylinders, each of said first and second drying cylinders being arranged between an adjacent pair of said drying cylinders in one of said normal drying groups, said sector having a magnitude greater than about 180°.

34. Dryer section of claim 33, wherein the web is transferred from said first drying cylinder in said drying module to a first one of said contact-drying cylinders in said one of said normal drying groups and runs over one of said leading cylinders arranged between said first contact-drying cylinder and a second one of said contact-drying cylinders in said one of said normal drying groups, the web being transferred from said second contact-drying cylinder to said second drying cylinder in said drying module and from said second drying cylinder in said drying module to additional contact-drying cylinders in said one of said normal drying groups.

35. A method for drying a paper web in a dryer section of a paper machine, comprising the steps of:

arranging a plurality of normal drying groups in a dryer section such that heated contact-drying cylinders are located in an upper row and leading cylinders are located in a lower row, pressing a first side of the paper web against heated faces of said contact-drying cylinders by a respective first drying wire in each of said normal drying groups, arranging at least one drying module in the dryer section, said drying module comprising only two drying cylinders having a heated cylinder face, each of said two drying cylinders being arranged between an adjacent pair of said drying cylinders in one of said normal drying groups, and pressing a second side of the web opposite to said first side against said heated cylinder face of each of said drying cylinders of said drying module, the second side of the web being pressed by a respective second drying wire over a sector of said drying cylinders, said sector having a magnitude greater than about 180°.

* * * * *